US006728981B1

(12) United States Patent
Gutierrez

(10) Patent No.: US 6,728,981 B1
(45) Date of Patent: May 4, 2004

(54) SYSTEM FOR CONVERTING A BED INTO A PLAY AREA

(76) Inventor: Ray Gutierrez, 1816 Tall Ships Ct., Toms River, NJ (US) 08755

( * ) Notice: Subject to any disclaimer, the term of this patent is extended or adjusted under 35 U.S.C. 154(b) by 0 days.

(21) Appl. No.: 10/299,444

(22) Filed: Nov. 19, 2002

(51) Int. Cl.[7] ..... A47C 19/22

(52) U.S. Cl. ..... 5/414; 5/426; 5/512; 5/907; 446/479

(58) Field of Search ..... 5/907, 414, 426, 5/512, 97; 446/479

(56) References Cited

U.S. PATENT DOCUMENTS

| | | | | | |
|---|---|---|---|---|---|
| 1,395,158 | A | * | 10/1921 | Smith | 5/113 |
| 3,188,661 | A | | 6/1965 | Rudy | |
| 3,950,796 | A | | 4/1976 | Hollingsworth | |
| 4,765,006 | A | * | 8/1988 | Jackson et al. | 5/658 |
| 4,833,743 | A | * | 5/1989 | Howell et al. | 5/426 |
| 4,852,598 | A | * | 8/1989 | Griesenbeck | 135/137 |
| 4,873,733 | A | * | 10/1989 | Wang | 5/98.1 |
| 5,303,434 | A | | 4/1994 | Arnold | |
| 5,507,046 | A | * | 4/1996 | Taylor | 5/414 |
| 5,761,756 | A | * | 6/1998 | Nowak et al. | 5/426 |
| 5,781,945 | A | * | 7/1998 | Scherer et al. | 5/246 |

OTHER PUBLICATIONS

Flexa Mobler A/S, Flexa, Catalog, 24 pages, Bjornkjjaervej 16, DK–8783 Hornsyld, Denmark.

* cited by examiner

*Primary Examiner*—Michael F. Trettel
(74) *Attorney, Agent, or Firm*—Notaro & Michalos P.C.

(57) ABSTRACT

A portable play enclosure area for use with interchangeable decorative theme covers converts a bed having removable bed rails into a play area. The portable play area upper enclosure has an upper structural frame defining a top area; a plurality of vertical bars having a distal end and a proximal end, the proximal end is coupled to the upper structural frame; and, a coupling mechanism for removably attaching the distal end of the plurality of vertical bars to the removable bed rails. The coupling mechanism enables the upper structural frame and plurality of vertical bars to be removed from the bed rails as a free standing.

19 Claims, 13 Drawing Sheets

SYSTEM FOR CONVERTING A BED INTO A PLAY AREA

FIELD OF THE INVENTION

This invention relates accessories for use with beds and more particularly to a play accessory.

BACKGROUND OF THE INVENTION

Children enjoy playing in imaginary structures of castles, ships, racecars, tents and other environments. Typically the structures take up considerable limited floor space in a bedroom or other rooms and are limited to a single scene or environment. The clutter created by such freestanding play structures limits their practical usefulness. Tent like play areas are available to convert a bed into a play area, however they are not sturdy, easy to set up or remove without disassembly. It is difficult to make the child's bed with a tent like play area attached.

Therefore there is a need for a bed enclosure, which can provide a variety of interchangeable themes, be easily retrofitted to an existing bed, is portable and easily removed.

SUMMARY OF THE INVENTION

In one aspect, the present invention is a portable play area for use with interchangeable decorative theme covers for converting a bed having removable bed rails into a play area. The portable play area comprises: an upper enclosure having an upper structural frame defining a top area; a plurality of vertical bars having a distal end and a proximal end, the proximal end coupled to the upper structural frame; and, a coupling mechanism for removably attaching the distal end of the plurality of vertical bars to the removable bed rails; wherein the coupling mechanism enables the upper structural frame and plurality of vertical bars to be removed from the bed rails as a free standing unit.

BRIEF DESCRIPTION OF THE DRAWINGS

A more complete understanding of the present invention may be obtained from consideration of the following description in conjunction with the drawings in which.

DETAILED DESCRIPTION OF ILLUSTRATIVE EMBODIMENTS

Figure 1:
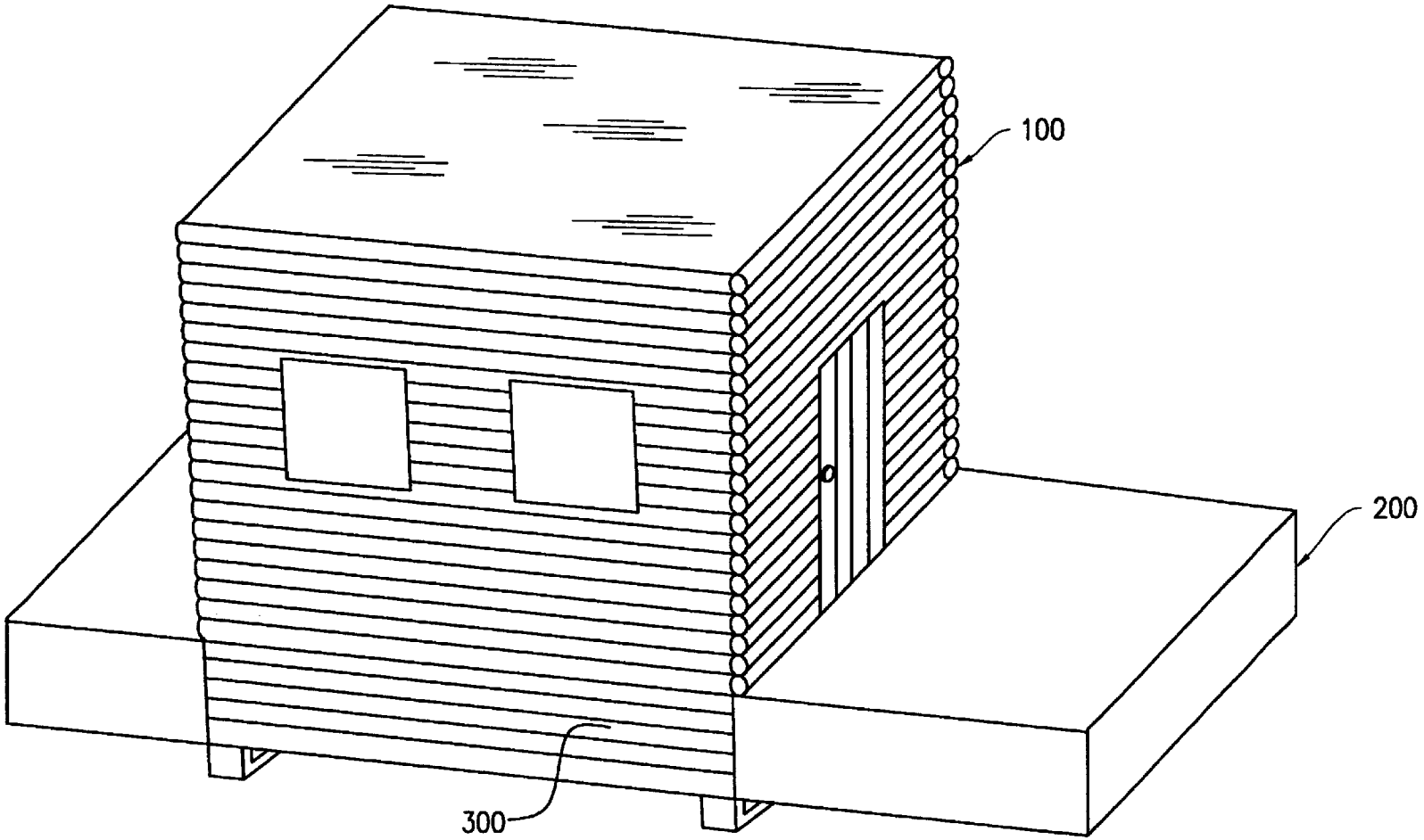
FIG. 1 is a perspective view of the system for converting a bed into a play area with a decorative covering attached.

Although the present invention, a portable system for converting a bed into a play area with interchangeable themes is particularly well suited for use with a child's bed and will be so described herein, it is equally well suited for use with an adult's bed and can be easily configured with lights, swings, mirrors and other suitable accessories.

While play enclosures that attach to beds are commercially available, they typically have several shortcomings. In particular, canopy tent enclosures, such as that described in U.S. Pat. No. 5,303,434 entitled Bed Tent, which issued on Apr. 19, 1994 to William T. Arnold, attach to the bed with an elastic type of material, combined with their collapsible frame members, are not sturdy enough to prevent the occupant from accidentally falling off the bed. The result is a consistent apprehension for everyone involved. This concern is magnified greatly in the top bed of bunk beds and other beds that are significantly suspended and or elevated from the floor. This apprehension severely limits the purpose of the play enclosure environment. Canopy tent enclosures are further limited by the short life span of the material, mechanical devices and mechanisms used. Other bed enclosure types include those where structural components of the play enclosure often are also structural components of the bed itself and/or require mechanical combination with structural components of the bed. This type of bed enclosure requires the purchase of the structural components and typically the particular bed frame from the bed manufacture. As a result the owner of an existing bed does not have access to these products. Additionally, they often require labor-intensive effort along with tools to remove and set up and thus discourages its use and severely limits it practical portability.

Other bed pay enclosures are integral to the design of the bed, as described in U.S. Pat. No. 3,950,796 entitled Article Of Furniture issued Apr. 20, 1976 to Gary R. Hollingsworth. This type of bed play enclosure essentially limits the ability to use the bed without the play enclosure.

Typically, available bed enclosures are limited a very few and often only one theme, which makes their initial appeal and useful play-life limited.

The present invention, a portable system for converting a bed into a play area with interchangeable themes, has a lower half constructed similar to modem day 'safety side bed rails'. The main purpose of the bed rail type of construction is to protect the occupant from falling off the bed. Being on two sides of the bed, these bed rails provide a safe reassuring environment. The lower half of the enclosure may be used alone, independent of the top half, as a bedtime/naptime bed rail. The sturdy lower half can lock in place in both an upright 'used' position and in a down 'closed' position (not shown). The top half of the bed play enclosure, preferably made of similar materials and format, attaches to the two lower halves thus providing added stability and safety to the bed enclosure. The end result is a safe sturdy long lasting bed enclosure.

Typical commercial bed play enclosures, as previously discussed require structural components of the bed itself and or require mechanical combination with structural components of the bed, have several shortcomings. To construct these bed enclosures they often require tools that are not normally stored near the bed. Their construction is often are labor intensive and time consuming. Another disadvantage is frequently the manufactures often require parts that are available only on their bed frame or require someone to first buy their bed frame before they make their bed enclosure available. As a result if someone already has a bed and frame from a different manufacture, it is unlikely that they will be able to have access to that enclosure.

The present invention, a portable system for converting a bed into a play area with interchangeable themes is portable and attaches to practically any standard bed. The lower half of the bed enclosure has spaced foot bars that slide under the mattress. The frame that keeps the mattress supported is the same frame that supports the foot bars. The bed enclosure typically does not require any additional structural components to attach to the frame and therefore is not limited to beds and frames made by particular manufactures. The present invention, a portable system for converting a bed into a play area with interchangeable themes uses only a few, flexible easily connecting parts to the core of the bed enclosure. Therefore it is easy to remove the bed enclosure from one bed and attach it to another or store away from the bed. The bed play enclosure also does not require any tools for its assembly. The top half of the enclosure can also be used without a bed on any solid surface. This only requires extension of the legs and attachment of rubber feet like accessories to the legs. The present invention play enclosure provides the flexibility for use with various interchangeable decorative cover themes.

Referring to FIG. 1 there is shown a perspective view of the system for converting a bed into a play area with a decorative covering attached. The system for converting a bed into a play enclosure (play area, toy enclosure, etc.) 100 is shown installed with a mattress 200 which is supported by a bed frame (not shown). A decorative covering 300 is draped over the play enclosure 100. While shown in the form of a house, various images and shapes such as automobiles, rocket ships, castles, buildings, animals and cartoon characters can be used interchangeably. Many other accessories that are available, but not limited to, are periscopes, internal light sources, signs, audio communication devices and tables. The choices of decorative coverings are essentially limitless and easily updated as themes and desires change. The covering can be material similar to the bedroom theme thus enhancing and complimenting the general theme. In one embodiment, the covering has action figures, sports themes, educational themes, or any other theme that the user might desire and or wish to obtain. Being the core enclosure is a box like structure it will be very easy to create and or obtain decorative covering that can be draped over or directly attached to the structure. This flexibility will lead to countless hours of enjoyment and creativity.

Figure 2:
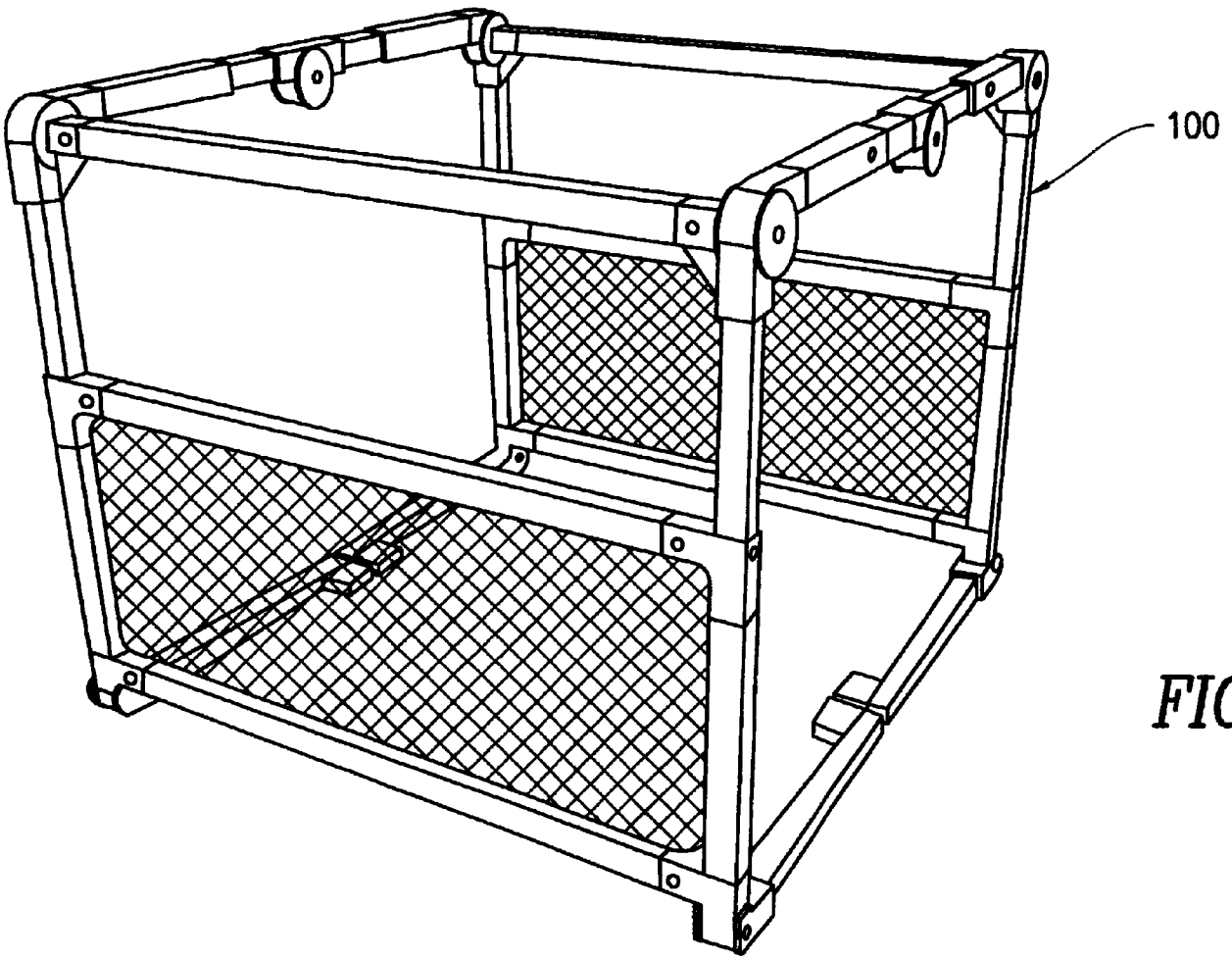
FIG. 2 is a perspective view of the system for converting a bed into a play enclosure without a decorative covering, play enclosure mesh or bed.

Referring to FIG. 2 there is shown a perspective view of the system for converting a bed into a play area, play enclosure 100, without a decorative covering, top play enclosure mesh or bed. The height should be only enough to prevent occupant from standing in bed, with the length sufficient enough to allow occupant to enjoy the space in the bed. The shape invites the use of unlimited accessories and gadgets.

Figure 3:
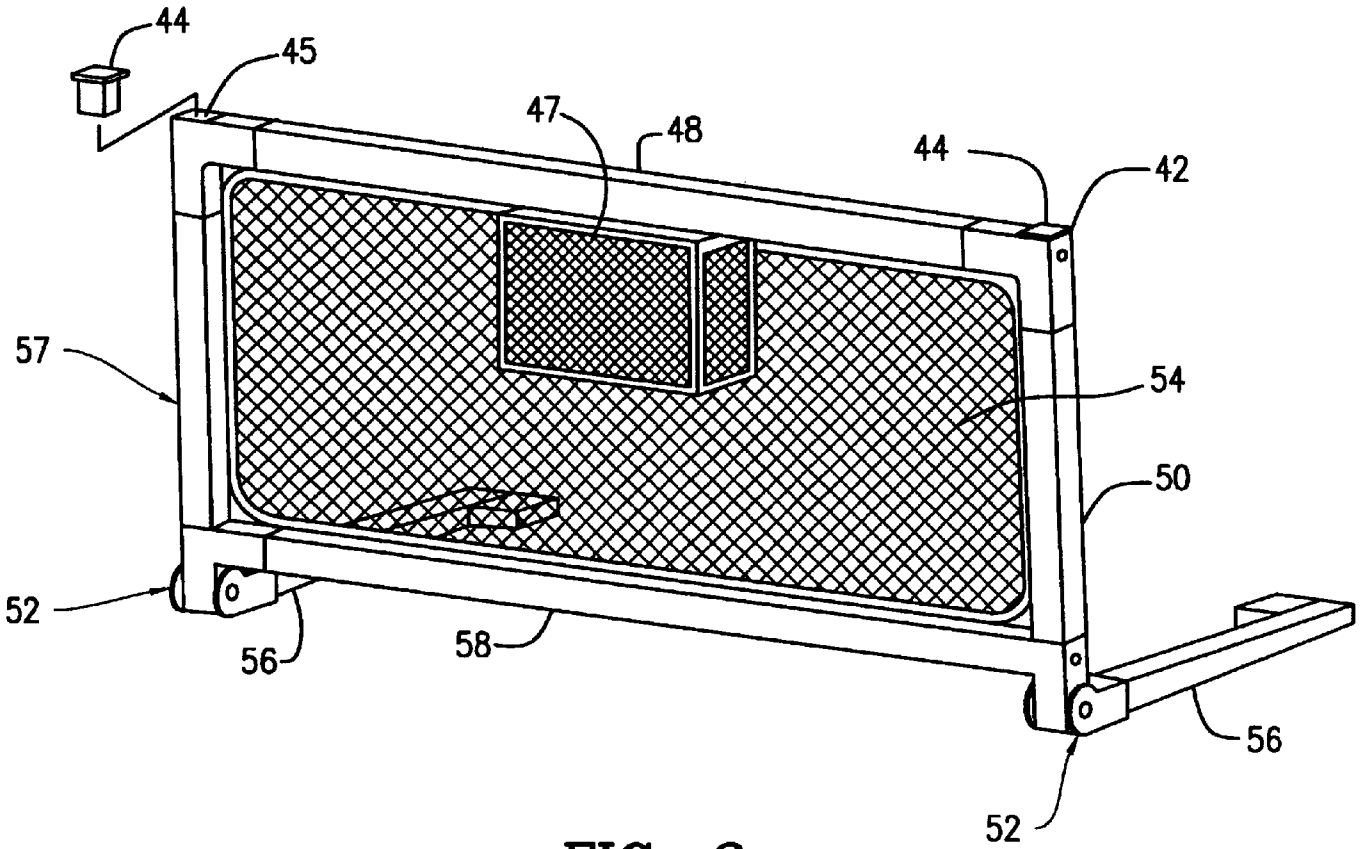
FIG. 3 is a perspective view a preferred embodiment of the bed rail.
Figure 4:
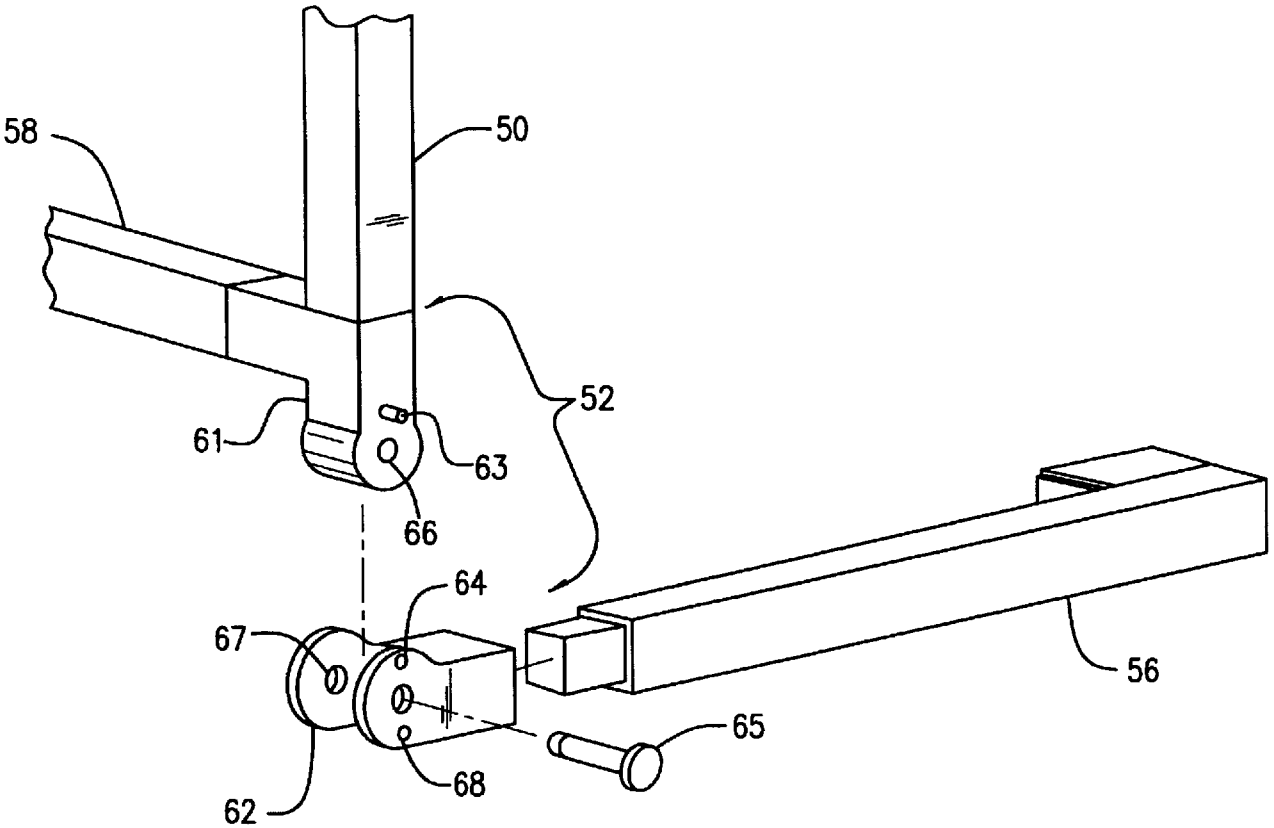
FIG. 4 is a detailed partial exploded view of FIG. 3 showing the bed rail pivoting subassembly with the bed rail support arm.

Referring to FIGS. 3 and 4 there is shown a perspective view of a preferred embodiment the bed rail 57. In this embodiment, it has a mesh covering 54 with a pocket 47 and the openings 45 on the top portion of the bed rail 57, which receives the lower portion of the enclosure 100. The bed rail arms 56 are connected to the bed rail pivoting assembly 52 which are placed under the mattress. The arms 56 are ideally made of and or covered with a material having sufficient friction that resists their unintentional sliding out from under the mattress. The bed rail pivoting assembly 52 partially exploded in FIG. 4 is composed to two main components, an inner bed rail pivoting subassembly 61 and an outer bed rail pivoting subassembly 62, which attached to the bed rail arm 56, has an outer bed rail pivoting subassembly-opening 67 that receives the outer bed rail pivoting subassembly-securing screw 65. The bed rail subassembly securing screw 65 passes through both the outer bed rail pivoting subassembly opening 67 and inner bed rail pivoting subassembly opening 66 in order to secure the two bed rail subassemblies 61 and 62 together. The outer bed rail pivoting subassembly pinhole. 64 that is part of the outer bed rail subassembly 62 receives the inner bed rail pivoting subassembly pin 63 when the bed rail is in the locked open position. The inner bed rail pivoting subassembly 61, which rotates on the outer bed rail pivoting 62 subassembly via the bed rail securing pin 65 and locks via the pin 63 and pinhole 64, attaches to the lower horizontal bed rail bar 58 and vertical bed rail bar 50. Pinhole 68 is used to lock the subassembly in the closed position (not shown). In FIG. 3 the two vertical bed rail bars 50 make up the lateral ends of the bed rail. The vertical bars 50 attach to the inner bed rail pivoting subassembly 61 inferiorly and to the bed rail subassembly 42 superiorly. The lower horizontal bed rail bar 58 supports the lower end of the bed rail where it attaches to the inner bed rail pivoting subassembly 61. The upper horizontal bed rail bar 48, which attaches to the medial aspect of the bed rail subassemblies 42, supports the upper half of the bed rail 57. In the preferred embodiment, the bed rail cover 54 is a synthetic mesh that attaches to adjacent bars 50, 48 and 58 via a sleeve mechanism. The covering bed rail mesh 54, in the preferred embodiment, also contains at least one storage bed rail pocket 47 made of synthetic mesh material.

Figure 5:
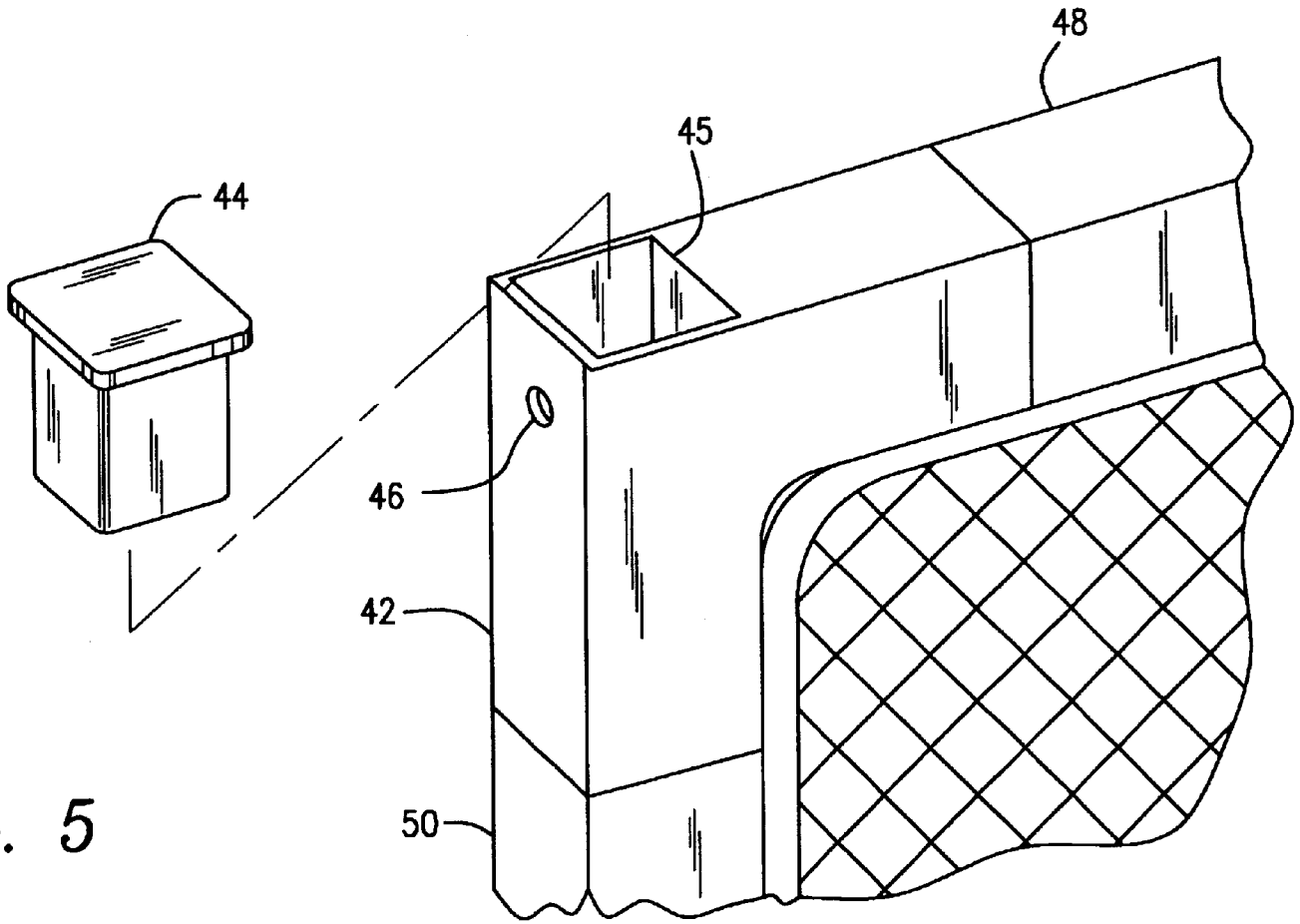
FIG. 5 is a detailed partial exploded view of FIG. 3 showing the preferred opening on the top portion of the bed rail along with a plug.
Figure 6:
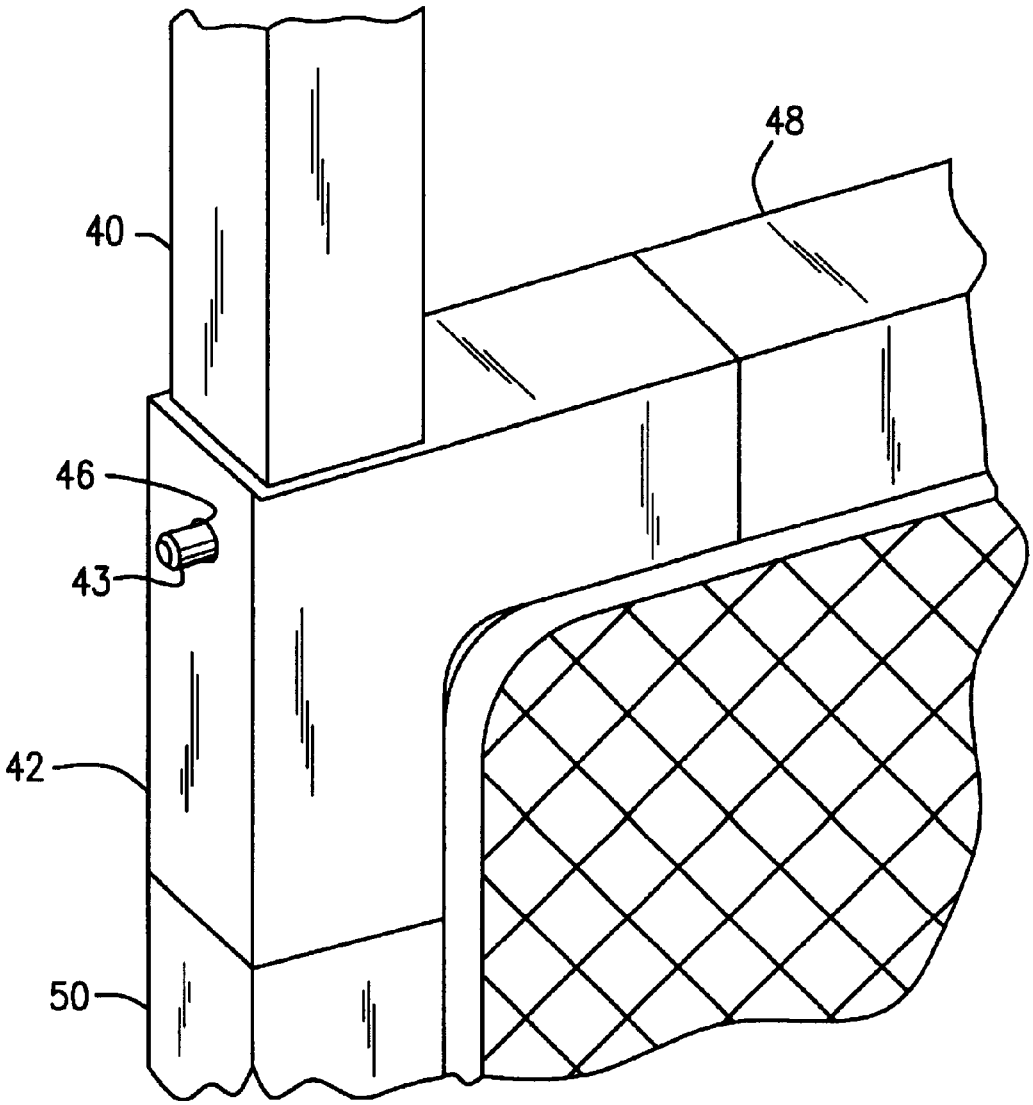
FIG. 6 is the view shown in FIG. 5 with the play enclosure attached to the bed rail.

Referring to FIGS. 5 and 6 there is shown a perspective view of the bed rail subassemblies 42 are shown in detail with respect to the coupling mechanism which attaches the upper horizontal bar 48 medially and vertical bed rail bars 50 inferiorly. The bed rail subassembly opening 45, is adapted to receive the bed rail subassembly plug 44, when the upper play enclosure is not in use, and can receive the lower half of the play enclosure vertical bar 40 when the plug 44 is removed. The bed rail subassembly play enclosure pinhole 46, which is part of the bed rail subassembly 42, locks the play enclosure vertical bar 40 via the play enclosure lower vertical bar pin 43.

Figure 13:
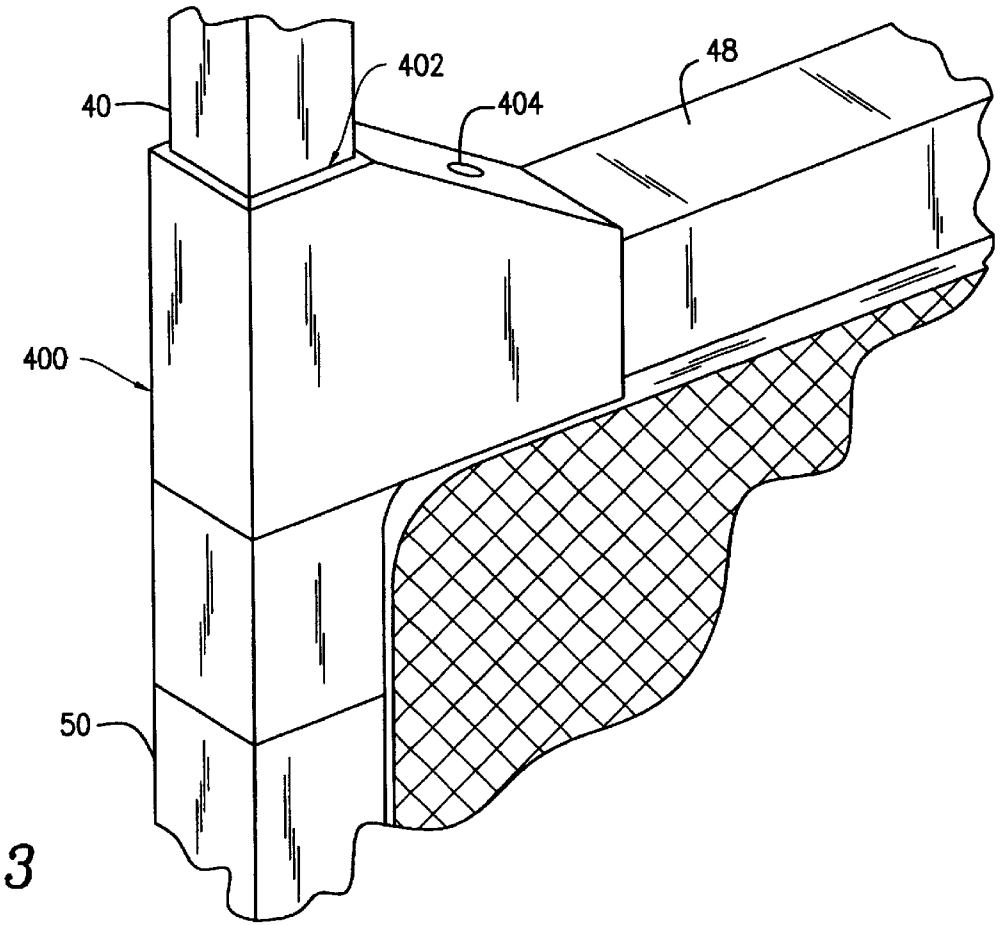

Referring to FIG. 13 there is shown an alternative embodiment of the play enclosure 100, where a coupling element 400 is adapted to slide over the top of the bed rail 48. The coupling element 400 may snap on as well as can be attached with an adhesive (not shown) such as tape strips, etc., or a suitable fastener 404 such as a screw, pop rivet, etc. The coupling element 400 has an opening 402 with the distal end of the vertical bars 40 adapted to slide into the opening 402. In yet another embodiment (not shown), the coupling mechanism 400 is integral to each of the distal ends of the plurality of vertical bars is adapted to slide over the top of the bed rail, similar to what is shown in FIG. 13.

Referring to FIG. 4 there is shown a detailed partial exploded view of FIG. 3 showing the bed rail pivoting subassembly 52 with the bed rail support arm 56. Referring to FIG. 5 there is shown a detailed partial exploded view of FIG. 3 showing the opening 45 on the top portion of the bed rail 57 along with plug 44 removed. Referring to FIG. 6 there is shown the view shown in FIG. 5 with the lower half of the enclosure 100 attached to the bed rail 57.

Figure 7:
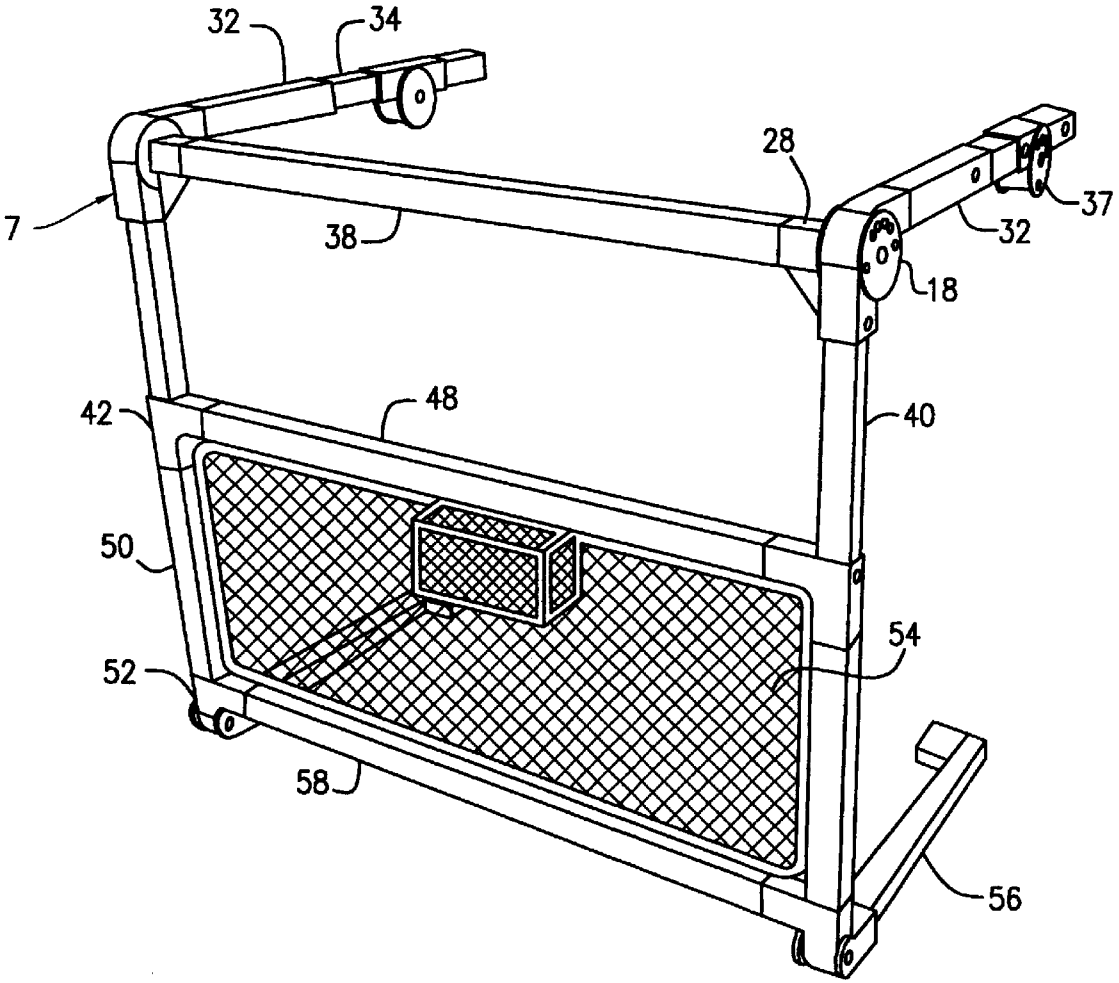
FIG. 7 is the view shown in FIG. 3 with the addition of the attached upper half of the play enclosure without the decorative covering, play enclosure mesh or bed.

Referring to FIG. 7 there is shown a partial perspective of the view shown in FIG. 3 with the addition of the attached upper half of the play enclosure 100 without the decorative covering 300 or the play enclosure mesh. This illustrates the way the vertical bar 40 (the legs) attaches inferiorly to the bed rail subassembly 42 and superiorly to the inferior half of the play enclosure pivoting assembly 7. This play enclosure pivoting subassembly 7 also attaches medially at its outer pivoting subassembly horizontal base 28 to the play enclosure horizontal bar 38, and transversely to the play enclosure transverse bars 32.

Figure 8:
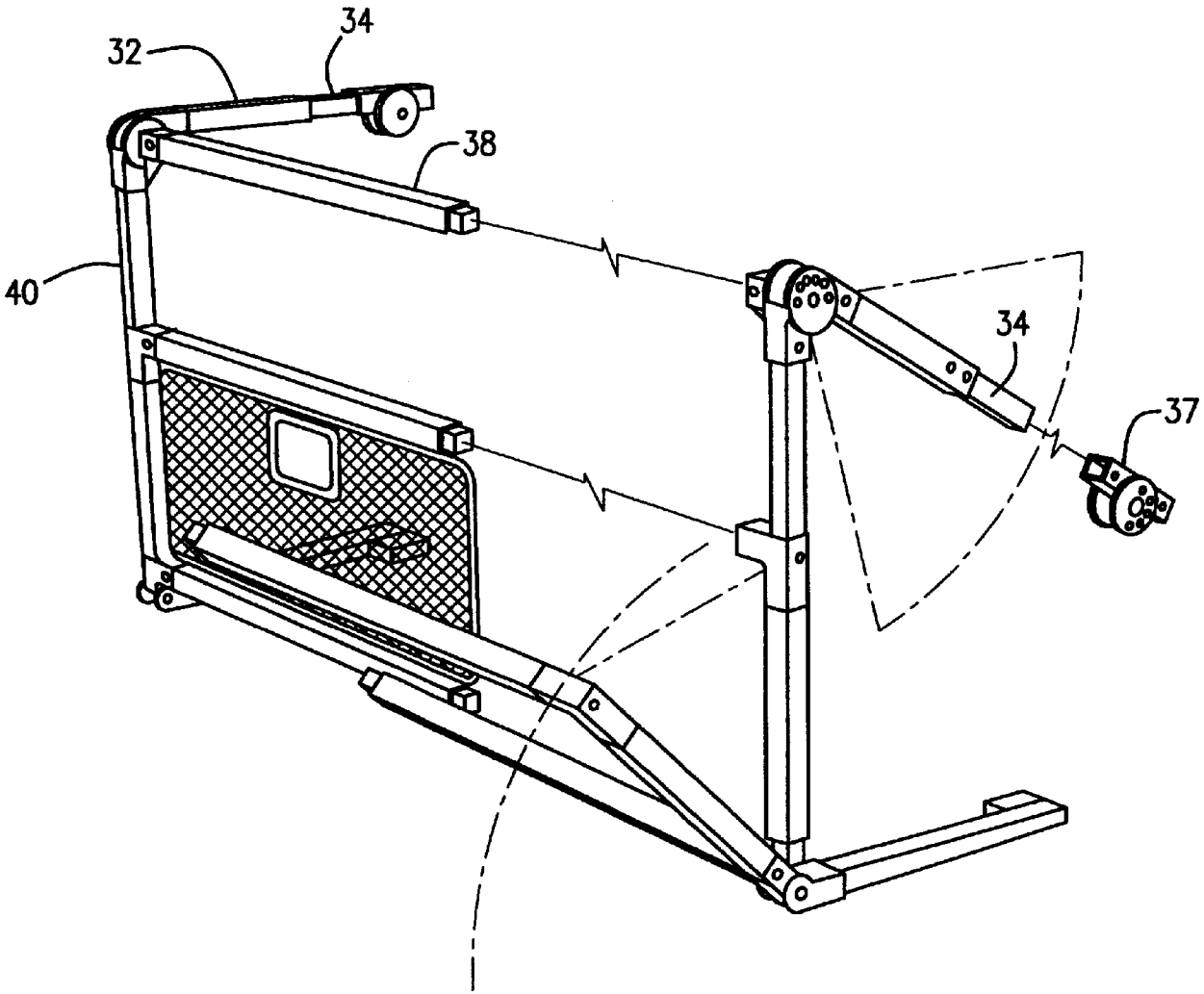
FIG. 8 is the view shown in FIG. 7 with the arms rotating from a closed to an open position.

Referring to FIG. 8 there is shown the view in FIG. 7 but with the arms 32 rotating from a closed to an open position. The pivoting arch assembly 37 attaches to the telescoping bar 34.

Figure 9:
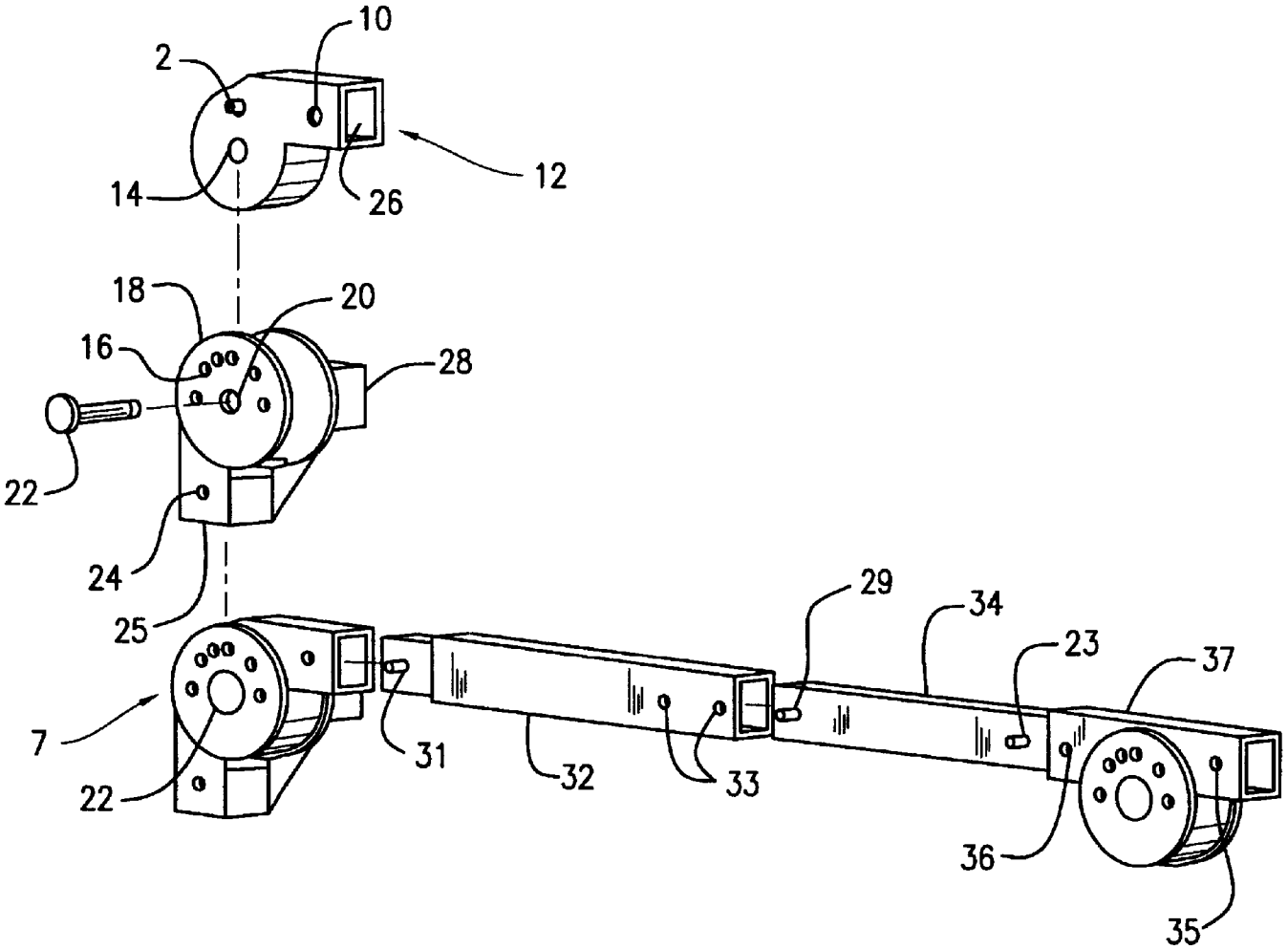
FIG. 9 is a detailed partial exploded view of FIG. 7 with the play enclosure pivoting assembly.
Figure 10:
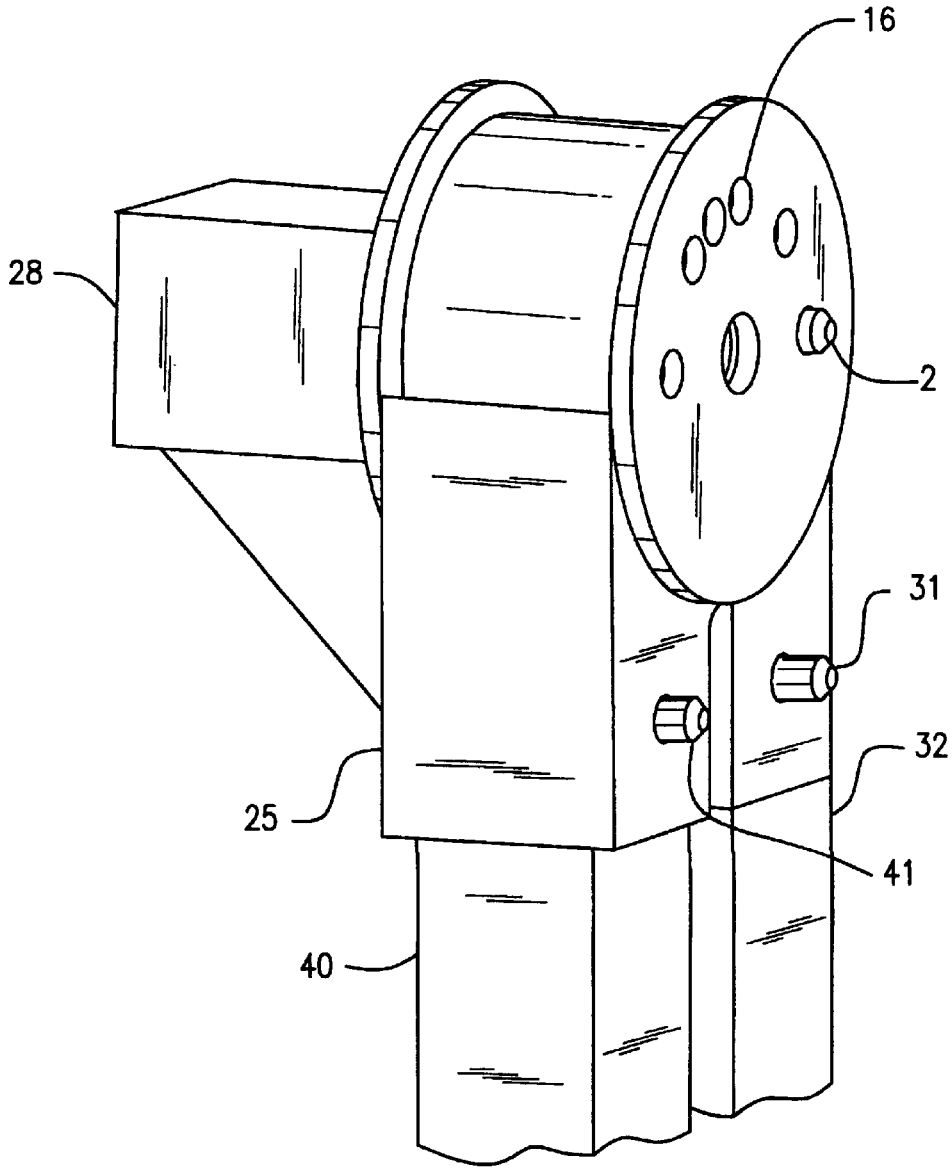
FIG. 10 is a partial perspective view of the play enclosure pivoting assembly in the closed position.

Referring to FIG. 9 there is shown a detailed partial exploded view of FIG. 7 with the play enclosure pivoting assembly separated into its two main components, inner pivoting subassembly and outer pivoting subassembly. The play enclosure pivoting assembly 7 is shown separating into its two main components, the inner pivoting subassembly 12 and the outer pivoting subassembly 18. The outer pivot subassembly 18 has two bases, the horizontal base 28 and vertical base 25. The outer pivoting subassembly vertical base 25 has a pinhole 24 that works in conjunction with the play enclosure vertical bar 40 and its play enclosure assembly upper vertical bar pin 41 as shown in FIG. 10. The outer pivoting subassembly horizontal base 28 receives the play enclosure assembly horizontal bar 38. The play enclosure assembly securing screw 22 penetrates both the outer pivoting subassembly circular groove 20 and the inner pivot subassembly circular groove 14 simultaneously thus securing and allowing rotation of the inner pivoting subassembly assembly 12 on the outer pivoting subassembly 18. The pivot assembly-locking pin 2 (which is part of the inner pivoting subassembly 12) locks in place with the outer pivoting subassembly locking pinholes 16. Depending where the locking pin 2 interfaces with the pinholes 16 determines what angle the play enclosure assembly transverse arm 32 lies. The transverse arm 32 attaches to the inner pivot subassembly 12 at its receiving base 26. At the base 26 the play enclosure assembly-locking pin 31 attaches to the inner pivot subassembly pinhole 10. The transverse arm 32 has telescoping pinholes 33 which when connected to the inner telescopic locking pin 29 determines the extended length of the telescoping bar 34. The telescoping bar 34 has an arching pin 23 that attaches to the pivoting arch subassembly pinhole 36. The pivoting arch assembly 37 has another pinhole 35 that attaches to adjacent telescoping bars 34 and their respective pins 23.

Figure 11:
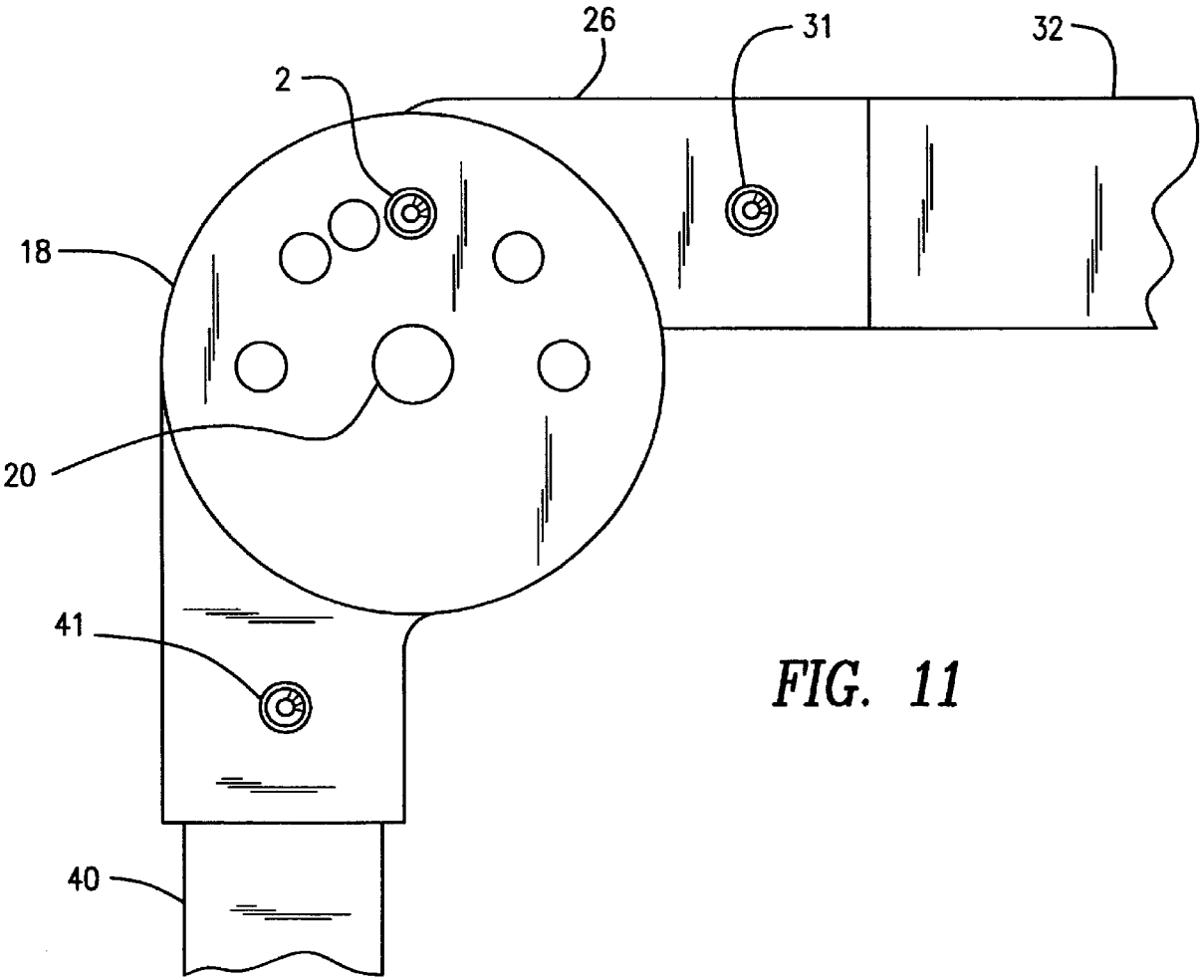
FIG. 11 is a side view of the play enclosure pivoting assembly in open 90-degree position.

Referring to FIGS. 10 and 11 there are shown perspective views of the play enclosure 100 pivoting assembly 7 in the closed position and the 90-degree open position. In the closed position, the play enclosure assembly vertical bar 40 lies next to the play enclosure assembly transverse bar 32. In the closed position the pivot assembly-locking pin 2 lies in the 3 o-clock position in conjunction with the outer pivoting subassembly locking pinholes 16. The vertical bar 40 attaches to the outer pivoting subassembly vertical base 25 and locks into place with the play enclosure assembly upper vertical bar pin 41. When the transverse bar 32 is in the open 90-degree position the locking pin 2 lies in the 12 o-clock positions of the pinholes 16.

Figure 12:
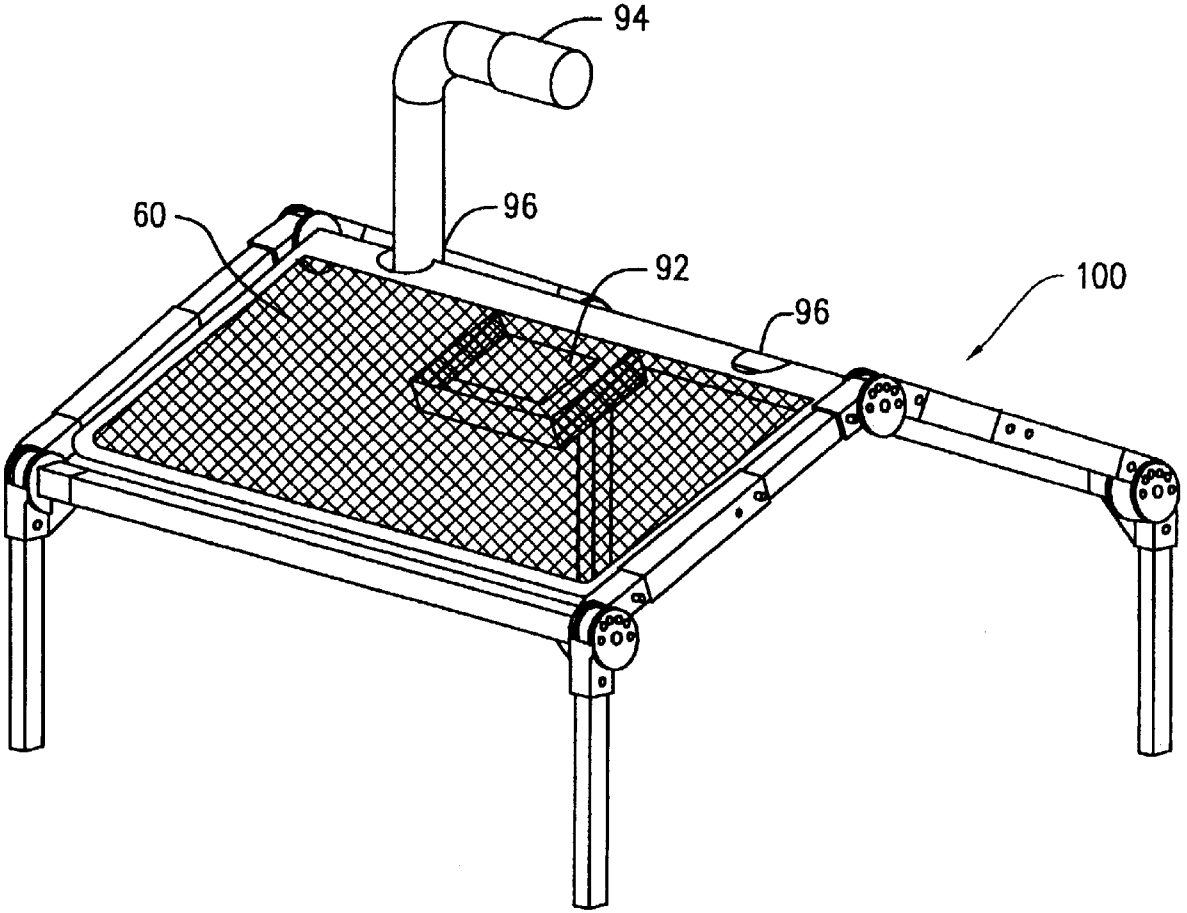
FIG. 12 is a view similar to FIG. 2 showing only the top half of the play enclosure, the play enclosure, with a mesh pocket, accessory openings and periscope; and, FIG. 13 is an alternate embodiment of the coupling mechanism for removably attaching the top half of the play enclosure to the bed rails.

Referring to FIG. 12 there is shown a view similar to FIG. 2 showing only the top half of the play enclosure with a mesh pocket 92, accessory openings 96 and optional periscope 94.

The play enclosure 100 can be adjusted to different angles. The play enclosure 100 preferentially comes in two identical halves with each half being comprised of two transverse bars 32, two telescoping bars 34, a pivoting arch assembly, a horizontal bar 38, a play enclosure mesh 60, two play enclosure pivoting assemblies 7, and two vertical bars 40. The play enclosure mesh 60 attaches to the transverse bars 32, telescoping bars 34 and horizontal bar 38 preferentially via a sleeve mechanism. It will have a pocket 92 that can carry various objects including but not limited to battery operated light sources. The mesh ideally has a midline VELCRO (a trademark) fastener surface that will allow it to attach to the adjacent mesh. This midline VELCRO fastener surface will also referentially have opening 96 that will facilitate and encourage accessories such as a periscope 94.

In view of the foregoing description, numerous modifications and alternative embodiments of the invention will be apparent to those skilled in the art. While the upper portion of the portable play enclosure can be free standing, optional leg extensions and rubber feet like accessories can be used with or without a stabilizing base to increase the height of the play enclosure such that a child can easily walk into the play enclosure. Accordingly, this description is to be construed as illustrative only and is for the purpose of teaching those skilled in the art the best mode of carrying out the invention. Details of the structure, including but not limited to the mechanism for adjusting angles, coupling elements together and coupling to the bed rail may be varied substantially without departing from the spirit of the invention, and the exclusive use of all modifications, which come within the scope of the appended claim, is reserved.

I claim:

1. A portable play area with interchangeable decorative theme covers for converting a bed having removable bed rails into a play area the portable play area comprising:

an upper enclosure having an upper structural frame defining a top area;

a plurality of vertical bars having a distal end and a proximal end, the proximal end coupled to the upper structural frame; and, a coupling mechanism for removably attaching the distal end of the plurality of vertical bars to the removable bed rails;

wherein the coupling mechanism enables the upper structural frame and plurality of vertical bars to be removed from the bed rails as an assembled free standing unit, and wherein the plurality of vertical bars pivot relative to the upper structural frame from a vertical position to a horizontal position whereby the height of the portable play area is reduced such that the portable play area can be stored under the bed.

2. The portable play area as recited in claim 1 further comprises a mesh coupled to the upper structural frame so as to span the top area.

3. A portable play area with interchangeable decorative theme covers for converting a bed having removable bed rails into a play area the portable play area comprising:

an upper enclosure having an upper structural frame defining a top area;

a plurality of vertical bars having a distal end and a proximal end, the proximal end coupled to the upper structural frame; and, a coupling mechanism for removably attaching the distal end of the plurality of vertical bars to the removable bed rails;

wherein the coupling mechanism enables the upper structural frame and plurality of vertical bars to be removed from the bed rails as an assembled free standing unit, and wherein the upper structural frame further comprises a mechanism for angular adjustment to change the top area's shape.

4. A portable play area with interchangeable decorative theme covers for converting a bed having removable bed rails into a play area the portable play area comprising:

an upper enclosure having an upper structural frame defining a top area;

a plurality of vertical bars having a distal end and a proximal end, the proximal end coupled to the upper structural frame; and, a coupling mechanism for removably attaching the distal end of the plurality of vertical bars to the removable bed rails;

wherein the coupling mechanism enables the upper structural frame and plurality of vertical bars to be removed from the bed rails as an assembled free standing unit, the coupling mechanism further comprises the distal end of the plurality of vertical bars being adapted to slide into an opening in the bed rail, and the distal ends of at least one of the plurality of vertical bars releasably locks when slid into the opening in the bed rail.

5. A portable play area with interchangeable decorative theme covers for converting a bed having removable bed rails into a play area the portable play area comprising:

an upper enclosure having an upper structural frame defining a top area;

a plurality of vertical bars having a distal end and a proximal end, the proximal end coupled to the upper structural frame; and, a coupling mechanism for removably attaching the distal end of the plurality of vertical bars to the removable bed rails;

wherein the coupling mechanism enables the upper structural frame and plurality of vertical bars to be removed from the bed rails as an assembled free standing unit, and wherein the coupling mechanism further comprises the distal end of the plurality of vertical bars being adapted to slide over the top of the bed rail.

6. The portable play area as recited in claim 5 wherein the distal ends of at least one of the plurality of vertical bars releasably locks when slid over the top of the bed rail.

7. The portable play area as recited in claim 5 further comprising a decorative cover supported by the upper structural frame.

8. A portable play area with interchangeable decorative theme covers for converting a bed having removable bed rails into a play area the portable play area comprising:

an upper enclosure having an upper structural frame defining a top area;

a plurality of vertical bars having a distal end and a proximal end, the proximal end coupled to the upper structural frame;

a coupling mechanism for removably attaching the distal end of the plurality of vertical bars to the removable bed rails;

wherein the coupling mechanism enables the upper structural frame and plurality of vertical bars to be removed from the bed rails as an assembled free standing unit; and a coupling element adapted to slide over the top of the bed rail, the coupling element having an opening wherein the distal end of the plurality of vertical bars are adapted to slide into the opening in the coupling element.

9. A portable play area for converting a bed into a play area the portable play area comprising:

removable bed rails;

an upper enclosure having an upper structural frame defining a top area;

a plurality of vertical bars having a distal end and a proximal end, the proximal end coupled to the upper structural frame; and, a coupling mechanism for removably attaching the distal end of the plurality of vertical bars to the removable bed rails;

wherein the coupling mechanism enables the upper structural frame and plurality of vertical bars to be removed from the bed rails as an assembled free standing unit.

10. The portable play area as recited in claim 9 wherein the plurality of vertical bars pivot relative to the upper structural frame from a vertical position to a horizontal position whereby the height of the portable play area is reduced such that the portable play area can be stored under the bed.

11. The portable play area as recited in claim 9 wherein the upper structural frame further comprises a mechanism for angular adjustment to change the top area's shape.

12. The portable play area as recited in claim 9 further comprises a mesh coupled to the upper structural frame so as to span the top area.

13. The portable play area as recited in claim 9 wherein the coupling mechanism further comprises the distal end of the plurality of vertical bars being adapted to slide into an opening in the bed rail.

14. The portable play area as recited in claim 13 wherein the distal ends of at least one of the plurality of vertical bars releasably locks when slid into the opening in the bed rail.

15. The portable play area as recited in claim 14 further comprising a ball and spring indent mechanism to releasably lock the distal ends of the vertical bars when slid into the opening in the bed rail.

16. The portable play area as recited in claim 13 further comprising a plug adapted to slide into the opening in the bed rail.

17. The portable play area as recited in claim 9 wherein the coupling mechanism further comprises the distal end of the plurality of vertical bars being adapted to slide over the top of the bed rail.

18. The portable play area as recited in claim 17 wherein the distal end of at least one of the plurality of vertical bars releasably locks when slid over the top of the bed rail.

19. The portable play area as recited in claim 9 further comprising a decorative cover supported by the upper structural frame.

* * * * *